US008440030B2

(12) United States Patent
Lee et al.

(10) Patent No.: US 8,440,030 B2
(45) Date of Patent: May 14, 2013

(54) FINE SPHEROIDIZED STEEL SHEET WITH EXCELLENT HEAT TREATMENT CHARACTERISTIC AND METHOD FOR MANUFACTURING THE SAME

(75) Inventors: Chang-Hoon Lee, Pohang-shi (KR); Jea-Chun Jeon, Pohang-shi (KR); Jong-Sub Lee, Pohang-shi (KR); Ki-Soo Kim, Pohang-shi (KR)

(73) Assignee: POSCO, Pohang-shi (KR)

( * ) Notice: Subject to any disclaimer, the term of this patent is extended or adjusted under 35 U.S.C. 154(b) by 19 days.

(21) Appl. No.: 13/141,739

(22) PCT Filed: Dec. 21, 2009

(86) PCT No.: PCT/KR2009/007625

§ 371 (c)(1),
(2), (4) Date: Jun. 23, 2011

(87) PCT Pub. No.: WO2010/074463

PCT Pub. Date: Jul. 1, 2010

(65) Prior Publication Data

US 2011/0259483 A1 Oct. 27, 2011

(30) Foreign Application Priority Data

Dec. 24, 2008 (KR) ..... 10-2008-0133357

(51) Int. Cl.
*C22C 38/04* (2006.01)
*C22C 38/06* (2006.01)
*C21D 8/02* (2006.01)

(52) U.S. Cl.
USPC ..... 148/328; 148/320; 148/603; 148/651; 148/652; 148/659

(58) Field of Classification Search ..... 148/652, 148/659, 320, 328, 603, 651, 654
See application file for complete search history.

(56) References Cited

U.S. PATENT DOCUMENTS

| | | | | |
|---|---|---|---|---|
| 3,895,972 | A * | 7/1975 | Woodilla et al. | 148/652 |
| 2009/0095382 | A1 * | 4/2009 | Kariya et al. | 148/603 |
| 2009/0260729 | A1 | 10/2009 | Iizuka et al. | |
| 2010/0266441 | A1 | 10/2010 | Kariya et al. | |

FOREIGN PATENT DOCUMENTS

| | | | |
|---|---|---|---|
| JP | 02-221324 | * | 9/1990 |
| JP | 2000045029 | A | 2/2000 |
| JP | 2003073740 | A | 3/2003 |
| JP | 2008069452 | A | 3/2008 |
| KR | 20080012942 | A | 2/2008 |

* cited by examiner

*Primary Examiner* — Deborah Yee
(74) *Attorney, Agent, or Firm* — The Webb Law Firm

(57) ABSTRACT

A method for manufacturing a fine spheroidized steel sheet having an excellent heat treatment characteristic, the method including: i) manufacturing a high carbon slab that is formed of 0.3 to 1.0 wt % C, 0.1 to 1.2 wt % Mn, 0 to 0.4 wt % Si, 0.01 to 0.1 wt % Al, 0 to 0.01 wt % S, and balance Fe and an inevitably added impurity as residuals; ii) reheating the slab to a temperature of Ar3 transformation point or more; iii) roughing rolling the slab, and manufacturing a thin plate by performing finish rolling in an austenite region; iv) cooling the thin plate at a cooling speed of 50 to 300° C./sec; v) finishing the cooling of the thin plate at a temperature region of 400 to 650° C. and maintaining the temperature; vi) winding the thin plate at a temperature region of 450 to 700° C.; vii) performing cold rolling at a reduction ratio of 30% or more; and viii) spheroidizing annealing the cold rolled thin plate.

7 Claims, 3 Drawing Sheets

FINE SPHEROIDIZED STEEL SHEET WITH EXCELLENT HEAT TREATMENT CHARACTERISTIC AND METHOD FOR MANUFACTURING THE SAME

CROSS-REFERENCE TO RELATED APPLICATION

This application claims priority to and the benefit of Korean Patent Application No. 10-2008-0133357 filed in the Korean Intellectual Property Office on Dec. 24, 2008, the entire contents of which are incorporated herein by reference.

BACKGROUND OF THE INVENTION (a) Field of the Invention

The present invention relates to a high carbon steel sheet. More particularly, the present invention relates to a fine spheroidized steel sheet having a fine pearlite structure and an excellent heat treatment characteristic, and a method for manufacturing the same.

(b) Description of the Related Art

A high carbon steel sheet is a graphite steel sheet that has 0.3 wt % or more of carbon, and has a crystal structure with a pearlite crystal phase. The high carbon steel sheet has a high strength and a high hardness after a final process. As described above, since the high carbon steel sheet has the high strength and the high hardness, the high carbon steel sheet is used for tool steel or steel for machine structural use requiring the high strength and the high hardness.

As examples of the high carbon steel sheet used as the tool steel, there is JS-SK85 steel classified according to Japanese Industrial Standard. The JS-SK85 steel is used for parts for vehicles, needles for removers, razor blades, or stationary knives.

The high carbon steel sheet is generally manufactured as an intermediate product such as a hot rolled steel sheet by a continuous hot rolling process of a slab. The hot rolled steel sheet is manufactured by rolling the slab heated for hot rolling through roughing rolling and finish rolling in a predetermined thickness, cooling to an appropriate temperature in a run-out table (ROT), and winding using a scroll type of coil.

The hot rolled steel sheet is manufactured into a cold rolled steel sheet by using cold rolling after pickling and spheroidizing annealing processes. The cold rolled steel sheet having a desired thickness is manufactured by sequentially repeating an annealing process and a cold rolling process.

The cold rolled steel sheet is processed into a desired product through processes such as blanking or burring, and then, is processed into a final product through a QT (quenching and tempering) heat treatment.

The above information disclosed in this Background section is only for enhancement of understanding of the background of the invention and therefore it may contain information that does not form the prior art that is already known in this country to a person of ordinary skill in the art.

SUMMARY OF THE INVENTION

As described above, in general, after a high carbon steel used for processing is manufactured into a hot rolled steel sheet, spheroidizing annealing and cold rolling processes are performed so that a pearlite structure of a hot rolled high carbon steel is transformed into spheroidized cementite.

In general, for the purpose of smooth cold rolling, spheroidizing annealing is first performed, and then, cold rolling is performed, and processes such as the spheroidizing annealing and the cold rolling are repeated, such that a cold rolled high carbon steel that has microstructure with spheroidized cementite is manufactured.

However, in this process, the spheroidal temperature for complete spheroidization by first performing the spheroidizing annealing is increased, and the annealing is required for a long period of time.

As described above, in the case where the annealing is performed for a long period of time, the size of the transformed spheroidal carbide are too large, and a manufacturing cost is high, such that productivity becomes low.

In addition, after the hot rolling and the winding, the high carbon steel for processing that is spheroidizing annealed and cold rolled is processed into a product through representative processes such as drawing, stretching forming, stretch flange forming, and bending. In respect to the processed product, a quenching and tempering (QT) heat treatment is performed in order to implement high strength.

Herein, in the case where the microstructure of the high carbon steel is formed of two phases of ferrite and cementite, the shape, the size, and the distribution of cementite largely affect the processability and the QT heat treatment property.

That is, if the high carbon steel having the pearlite structure (lamellar structure of ferrite and cementite) is spheroidizing annealed, unspheroidized cementite (cementite of the pearlite lamellar layer) after the spheroidizing annealing remains, and the formability becomes poor and the QT heat treatment property is deteriorated by the unspheroidized cementite and the coarse spheroidized cementite structure.

This is because since voids are formed in a coarse cementite layer during the forming, breakage easily occurs, and since a redissolution speed of the coarse spheroidized cementite becomes slow during the QT heat treatment, it is difficult to ensure hardness after the heat treatment.

Meanwhile, in the case of spheroidizing annealing the high carbon steel that consists of structure of ferrite and pearlite, in order to reduce a spheroidizing time, a spheroidizing annealing time is reduced by first performing the cold rolling after the hot rolling.

In addition, in the pearlite structure, as an interval of the cementite layered structure is decreased, that is, the finer the structure is, the more the spheroidizing speed is improved, such that a time required to complete spheroidizing is reduced. There is a multistage spheroidizing annealing method for applying this, but the multistage spheroidizing annealing method has drawbacks in that it is not easy to perform multistage control and a manufacturing cost is high.

The present invention has been made in an effort to provide a high carbon hot rolled steel sheet having a fine cementite lamellar structure in order to reduce an annealing temperature and an annealing time in a spheroidizing annealing process that is a subsequent process.

Further, the present invention has been made in an effort to provide a high carbon fine spheroidized steel sheet in which a spheroidized carbide is fine and has an excellent heat treatment characteristic.

In addition, the present invention has been made in an effort to provide a method for manufacturing a high carbon steel sheet for manufacturing a fine spheroidized steel sheet having an excellent heat treatment characteristic.

An exemplary embodiment of the present invention provides a fine spheroidized steel sheet having an excellent heat treatment property, including 0.3 to 1.0 wt % of C, 0.1 to 1.2 wt % of Mn, 0 to 0.4 wt % of Si, 0.01 to 0.1 wt % of Al, 0 to 0.01 wt % of S, and Fe and an inevitably added impurity as residuals, wherein the fine spheroidized steel sheet has a fine pearlite structure in which a lamellar interval of cementite at a room temperature after a hot rolling is 1.0 μm or less, and a volume fraction of the fine pearlite is 80% or more.

In the fine spheroidized steel sheet, an average diameter of spheroidal carbide after spheroidizing annealing is 0.3 μm or less, and a spheroidized fraction is 90% or more, so that the heat treatment characteristic of the spheroidized steel sheet becomes excellent.

In the fine spheroidized steel sheet, a content of C (carbon) may be 0.6 to 0.9 wt %.

In addition, in the fine pearlite structure of the fine spheroidized steel sheet, the lamellar interval of cementite after the cold rolling may be 0.7 μm or less.

In addition, a shape of the fine pearlite may be a squashed pancake shape.

Another exemplary embodiment of the present invention provides a method for manufacturing a fine spheroidized steel sheet having an excellent heat treatment property, the method including: i) manufacturing a high carbon slab that is formed of 0.3 to 1.0 wt % of C, 0.1 to 1.2 wt % of Mn, 0 to 0.4 wt % of Si, 0.01 to 0.1 wt % of Al, 0 to 0.01 wt % of S, and Fe and an inevitably added impurity as residuals; ii}reheating the slab to a temperature of Ar3 transformation point or more; iii} roughing rolling the slab, and manufacturing a thin plate by performing finish rolling in an austenite region at a temperature of Ar3 transformation point or more; iv} cooling the thin plate on a run-out table at a cooling speed of 50 to 300° C./sec; v) finishing the cooling of the thin plate at a temperature region of 400 to 650° C., and maintaining the temperature; vi) winding the thin plate at a temperature region of 450 to 700° C.; vii) omitting pre-annealing of the wound thin plate and performing cold rolling at a reduction ratio of 30% or more; and viii) spheroidizing annealing the cold rolled thin plate.

In the method for manufacturing a fine spheroidized steel sheet, in the spheroidizing annealing step, spheroidizing annealing may be performed by maintaining at a temperature region of Ac1-200° C. to Ac1-50° C. for 5 hours or less.

Through the method for manufacturing a fine spheroidized steel sheet, after the winding step of the steel sheet, the microstructure of the thin plate has a fine pearlite structure in which the lamellar interval of cementite is 1.0 μm or less, and the volume fraction of the fine pearlite is 80% or more.

In the method for manufacturing a fine spheroidized steel sheet, a content of C (carbon) may be 0.6 to 0.9 wt %.

Further, after the cold rolling step, the microstructure of the thin plate may have a fine pearlite structure in which the lamellar interval of cementite may be 0.7 μm or less, and the shape of the fine pearlite may be the squashed pancake shape.

In addition, through the method for manufacturing a fine spheroidized steel sheet, after the spheroidizing annealing of the steel sheet, in the microstructure of the thin plate, the average diameter of the spheroidal carbides is 0.3 μm or less, and the spheroidized fraction is 90% or more.

According to an exemplary embodiment of the present invention, a fine spheroidized steel sheet having an excellent heat treatment characteristic has an effect of providing a hot rolled steel sheet having a fine pearlite structure without addition of boron (B).

According to an exemplary embodiment of the present invention, a fine spheroidized steel sheet having an excellent heat treatment characteristic has a technical effect of reducing a manufacturing process by directly performing cold rolling without spheroidizing annealing after hot rolling.

According to an exemplary embodiment of the present invention, a fine spheroidized steel sheet having an excellent heat treatment characteristic has a technical effect of providing durability and strength to a final product by having a fine spheroidal carbide.

According to an exemplary embodiment of the present invention, there is provided a technical effect of manufacturing a fine spheroidized steel sheet in which productivity is largely increased, and a heat treatment characteristic is very excellent by first controlling a microstructure of the hot rolled high carbon steel to have a fine pearlite structure and applying conditions of relatively low spheroidizing temperature and time by first performing cold rolling by 30% or more before spheroidizing annealing.

DETAILED DESCRIPTION OF THE EMBODIMENTS

Figure 1:
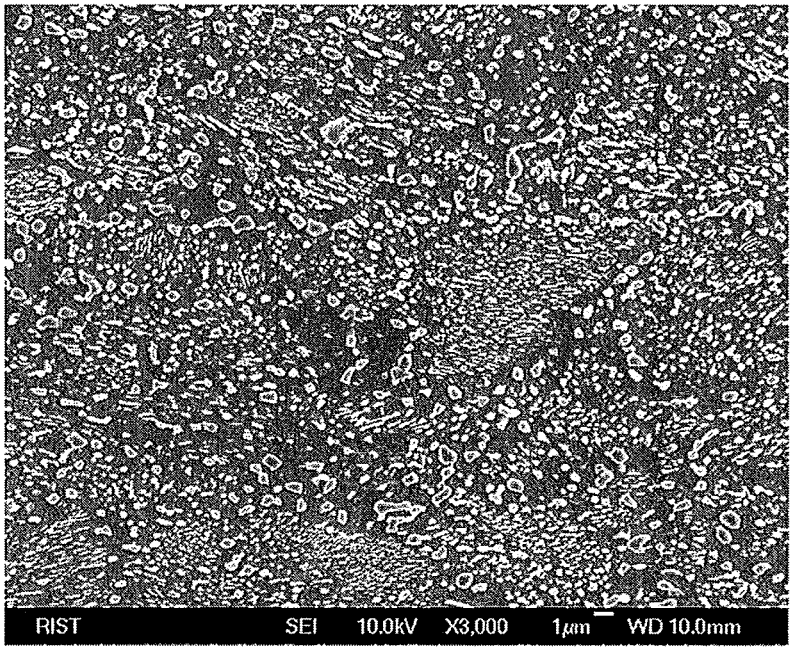
FIG. 1 is a microscopic picture that illustrates a microstructure of a hot rolled steel sheet manufactured according to a condition of inventive steel 3 according to an exemplary embodiment of the present invention.

The terminologies used herein are set forth to illustrate a specific exemplary embodiment but not to limit the present invention. It must be noted that, as used in the specification and the appended claims, the singular forms include plural references unless the context clearly dictates otherwise. It will be further understood that the terms "comprises" and/or "comprising," when used in this specification, specify the presence of stated properties, regions, integers, steps, operations, elements, and/or components, but do not preclude the presence or addition of one or more other properties, regions, integers, steps, operations, elements, and/or components thereof.

Unless it is not mentioned, all terms including technical terms and scientific terms used herein have the same meaning as the meaning generally understood by the person with ordinary skill in the art to which the present invention belongs. The terminologies that are defined previously are further understood to have the meaning that coincides with the contents that are disclosed in relating technical documents, but not as the ideal or very official meaning unless it is not defined.

Hereinafter, exemplary embodiments of a high carbon hot rolled steel sheet and a method for manufacturing the same according to the present invention will be described in detail, but the present invention is not limited to the following exemplary embodiments. Accordingly, it is to be understood that modifications will be apparent to those skilled in the art without departing from the spirit of the invention.

In the present invention, the content of the component element means wt % unless otherwise specified.

Hereinafter, a fine spheroidized steel sheet according to an exemplary embodiment of the present invention will be described in detail.

The fine spheroidized steel sheet according to an exemplary embodiment of the present invention includes 0.3 to 1.0 wt % of C, 0.1 to 1.2 wt % of Mn, 0 to 0.4 wt % of Si, 0.01 to 0.1 wt % of Al, 0 to 0.01 wt % of S, and Fe and an inevitably added impurity as residuals.

The reason why the component is limited in the fine spheroidized steel sheet according to the exemplary embodiment of the present invention will be described.

Carbon (C) is limited to 0.3 to 1.0%. One of the merits of the high carbon steel is ensuring of an increase of hardness by heat treatment, that is, excellent durability. For this reason, a lower limit of carbon may be 0.3%. In addition, in the case where carbon is added by 1.0% or more, in the microstructure of the hot rolled high carbon steel, coarse pro-eutectoid cementite is generated, thereby negatively affecting fining of carbide after the spheroidizing annealing. Accordingly, the range of carbon is 0.3 to 1.0%, and preferably 0.6 to 0.9%.

Manganese (Mn) is limited to 0.1 to 1.2%. In a manufacturing process of steel, sulfur (S) inevitably included is combined with iron (Fe) to form sulfides (FeS). The sulfides generate hot brittleness. Therefore, if manganese is added, formation of sulfides (FeS) by sulfur is prevented by first combining manganese with sulfur. However, if the addition amount of manganese is too small, since these effects cannot be implemented, hot brittleness is generated. Meanwhile, if the addition amount of manganese is too high, segregation such as center segregation or microscopic segregation becomes serious. As described above, if the segregation is generated, since manganese (Mn) is an element for forming cementite, the density and the size of carbide are increased in the segregation region. Accordingly, formability of the steel is reduced. Accordingly, the content of manganese may be limited to 0.1 to 1.2%.

Silicon (Si) is limited to 0.4% or less. Silicon is an element that causes a solid solution strengthening effect in steel, thus improving strength of ferrite. However, in the case where silicon is added in an excessive amount, the surface quality of the steel sheet is deteriorated by increasing scale defects in the steel. Accordingly, an upper limit of the content of silicon may be limited to 0.4%.

Aluminum (Al) is limited to 0.01 to 0.1%. Aluminum is added for two purposes. One purpose is to prevent formation of non-metallic inclusions during solidification by removing oxygen existing in the steel. The other purpose is to refine the grain size of the steel by fixing nitrogen existing in the steel by AlN. However, if the content of aluminum is too low, the addition purpose cannot be implemented, and if the content is too high, a problem of increasing strength of the steel is caused, and there is a problem of an increase in manufacturing costs in steel-making. Accordingly, the content of aluminum may be limited to 0.01 to 0.1%.

Sulfur (S) is combined with manganese to precipitate sulfides (MnS). However, since this precipitates acts as an impurity if the amount is increased, the content of sulfur may be managed as low as possible. In addition, the lower the content of sulfur is, the better the formability is. Accordingly, the content of sulfur may be limited to 0.01% or less.

Hereinafter, the method for manufacturing the high carbon hot rolled steel sheet according to the above exemplary embodiment will be described.

First, a high carbon steel slab that is formed of 0.3 to 1.0 wt % of C, 0.1 to 1.2 wt % of Mn, 0 to 0.4 wt % of Si, 0.01 to 0.1 wt % of Al, 0 to 0.01 wt % of S, and Fe and an inevitably added impurity as residuals is manufactured.

A thin plate is manufactured by reheating the steel slab by a general method, performing hot rolling, and performing hot finish rolling at an Ar3 transformation point or more.

The reason why the hot rolling finishing temperature is specified to the Ar3 transformation point or more is for preventing the hot rolling in the two phase region. In the case where the steel according to the exemplary embodiment of the present invention is hot rolled in the two phase region, pro-eutecotoid ferrite without carbide is generated in a large amount. As described above, in the hot rolling step, if pro-eutectoid ferrite is generated, in the final product, it is not possible to obtain a uniform distribution of carbides over the entire microstructure.

The thin plate that is final hot rolled in the above thickness is cooled in the run-out table (ROT) at a cooling speed of 50 to 300° C./sec, thereby finishing the cooling in a temperature region of 400 to 650° C. The thin plate after the cooling was finished is wound at the temperature region of 450 to 700° C. The microstructure of the thin plate manufactured by the above winding consists of a fine pearlite structure in which a lamellar interval of cementite is 1.0 μm or less, and the hot rolled high carbon steel sheet in which the volume fraction of the fine pearlite is 80% or more is manufactured.

As described above, before the thin plate that is cooled on the run-out table is wound by a winder, a pearlitic phase transformation ratio becomes 80% or more. Hereinafter, as described above, the reason for limiting the condition of the hot rolling process will be described.

In the case where before the thin plate that is cooled on the run-out table is wound, the pearlite phase transformation ratio is 80% or less, phase transformation into pearlite is implemented in a state where the hot rolled steel sheet is wound. Then, the temperature of the winding coil is increased by heat induced from phase transformation, and if the temperature is increased, the transformed pearlite structure becomes coarse. If a subsequent process is performed while the pearlite structure is in a coarse state, coarse cementite exists in the product after the annealing. As described above, if the coarse cementite exists, in the product processing process, a stress is concentrated on the cementite structure, such that the product is broken or heat treatment is not smoothly performed.

In addition, if the thin plate is not phase transformed into pearlite before the thin plate cooled on the run-out table is wound, and is phase transformed into pearlite in a wound state, a volume fraction of the crystal structure is changed, such that the shape of the hot rolled steel sheet wound in a coil state is vertically crushed and becomes an oval. The crushed coil is called a strip coil. As described above, if the strip coil is generated, since it is difficult to perform an operation in a subsequent amending process or pickling process, productivity or a real yield may be deteriorated.

In addition, in the high carbon hot rolled steel sheet according to the exemplary embodiment of the present invention, the reason why the heat induced from phase transformation is generated in the hot rolling process will be described.

In the case of the high carbon steel, as the content of C is increased, a curve nose of the CCT curve is moved to the right. Therefore, a starting time for a phase transformation of austenite to pearlite is delayed, and a finish time is delayed. In addition, as the content of C is increased, the heat induced form phase transformation according to difference in the heat capacity is increased.

Therefore, because of the above reason, after the final hot rolling of the thin plate is completed, before the thin plate is wound in the coil state, the phase transformation of austenite to pearlite may be completed by 80% or more.

To this end, the thin plate of which the final hot rolling is completed may be quickly cooled at an initial step of entry to the run-out table. In this case, the cooling speed may be 50 to 300° C./sec.

In the case where the cooling speed is 50° C./sec or less, the maintaining time on the run-out table is reduced as much, such that it is impossible to ensure a transformation ratio to pearlite, and in addition to pearlite, the ferrite phase may be generated. On the other hand, if the cooling speed is 300°

C./sec or more, the temperature is non-uniform in a width direction of a pearlitic hot rolled coil, such that the shape of the coil may be deformed.

As described above, the thin plate that may be quickly cooled on the run-out table at the cooling speed is cooled to a cooling stopping temperature of 400 to 650° C. and maintained for a predetermined time. The reason why the cooling is stopped in the temperature region and the temperature is maintained for a predetermined time is that a region obtaining the fine pearlite structure in the high carbon steel is in this temperature region. If the cooling stopping temperature is 400° C. or less, a bainite structure or a martensite structure is generated. If the above structure is generated, since strength and hardness of the high carbon steel are too high, in a subsequent process, cold rolling without annealing cannot be performed. In addition, in the case where the cooling stopping temperature is 650° C. or more, the coarse pearlite structure is generated. Therefore, since the spheroidizing speed of the carbide is made slow, spheroidizing annealing is performed for a long time, and as described above, if the spheroidizing annealing is performed for a long time, it is impossible to generate a fine spheroiddized carbide.

When the thin plate cooled to 400 to 650° C. on the run-out table passes through the run-out table, while a cooling temperature is maintained, the pearlitic phase transformation is completed by 80% or more and the thin plate is wound at 450 to 700° C.

In the case where phase transformation into fine pearlite occurs at the cooling stopping temperature region, since the winding temperature may be increased by the heat induced form phase transformation, the winding temperature is limited to 450 to 700° C.

If the hot rolling is performed under the above condition, the manufactured hot rolled steel sheet has a fine pearlite structure. Herein, pearlite means a layered structure where ferrite and cementite are alternately layered. Therefore, if pearlite becomes fine, the width of cementite included in the structure becomes fine, and in this case, an interval between cementites, that is, a cementite lamellar interval may be 1.0 μm or less.

As described above, the cementite lamellar interval of 1.0 μm or less means that the crystal structure has a fine pearlite structure, and in the manufactured hot rolled steel sheet, the volume fraction of fine pearlite phase is 80% or more.

The hot rolled steel sheet manufactured by the above method is first cold rolled without a spheroidizing annealing process.

In this case, the condition of the cold rolling includes a reduction ratio of 30% or more. If the cold rolling is performed, the structure becomes fine. In this case, the cementite lamellar interval included in the pearlite structure may be 0.7 μm or less. The fine cementite is intermittently broken, and pearlite is squashed, such that the fine structure has a pancake-like oval shape.

As described above, the steel sheet of which the cold rolling is completed is spheroidizing-annealed.

In the steel according to the exemplary embodiment of the present invention, the spheroidizing annealing is performed under the conditions of the temperature region of Ac1-200° C. to Ac1-50° C. and 5 hours or less. In the spheroidizing annealing, if the spheroidizing annealing is performed at the temperature of Ac1-200° C. or less, it is impossible to remove dislocations in the hot rolled structure. In addition, as described above, if the spheroidizing annealing is performed at the low temperature, it is impossible to spheroidize pearlite into lamellar cementite. In addition, in the spheroidizing annealing, if the spheroidizing annealing is performed at the temperature of Ac1-50° C. or more, as the spheroiddizing temperature is increased, the size of the spheroidized carbide becomes coarse. Accordingly, in the exemplary embodiment of the present invention, the temperature condition of the spheroidizing annealing is limited to the range of Ac1-200° C. to Ac1-50° C.

Meanwhile, if the spheroidizing annealing time is too short, spheroidization of the lamellar cementite of pearlite is not implemented, and if the time is too long, since spheroidized carbide becomes coarse, the annealing time is limited to 5 hours or less.

Under the above condition, if the steel sheet is spheroidizing annealed, in the microstructure of the steel sheet, an average diameter of spheroidized carbides is 0.3 μm or less, and a spheroidized ratio is 90% or more.

The fine spheroidized steel sheet having an excellent heat treatment property of the spheroidizing annealing steel having the above condition is manufactured.

EXAMPLE

By the vacuum induction melting method, the steel ingot of the composition shown in Table 1 was manufactured in a thickness of 60 mm and a width of 175 mm. After the manufactured steel ingot was reheated at 1200° C. for 1 hour, the hot rolling was performed so that the thickness was 4.3 mm.

TABLE 1

| Kind of steel | C | Mn | Si | Al | S | Others | Note |
|---|---|---|---|---|---|---|---|
| 1 | 0.22 | 0.61 | 0.19 | 0.04 | 0.0033 | Fe and impurity as residuals | Comparative material |
| 2 | 0.61 | 0.59 | 0.21 | 0.028 | 0.0029 | the same as above | Inventive material |
| 3 | 0.85 | 0.42 | 0.22 | 0.036 | 0.0022 | the same as above | Inventive material |

As shown in chemical compositions of a specimen shown in Table 1, steel 1 shown in Table 1 is a comparative material that does not belong to the scope of the invention, and steels 2 and 3 are steel that belongs to the composition scope of the inventive steel. The size of carbides according to the hot rolling and cold rolling manufacturing conditions in respect to the kind of steel of Table 1 was shown in the following Table 2.

The hot rolling condition of the specimen is that the hot rolling finishing temperature is the Ar3 transformation point or more. The specimen that was final hot rolled was cooled at the ROT cooling speed of 100° C./sec, cooled to the target cooling stopping temperature region of 400 to 650° C., maintained at 450 to 700° C. in the previously heated furnace for 1 hour, and cooled in the furnace. The specimen was simulated under the manufacturing condition of the hot rolled high carbon steel having the fine pearlite structure, which was the same as the above manufacturing condition.

The hot rolled high carbon steel was cold rolled at the reduction ratio of 20 to 40%, and spheroidizing annealing heat treated at the temperature region of 500 to 700° C. for 1 to 20 hours. In addition, a time until the spheroidized carbide was redissolved was measured, while the temperature of the previously manufactured steels having various sizes of spheroidized carbides was increased to 900° C. and the steels were austenitizing heat treated. The result was described in Table 2.

TABLE 2

| Kind of steel | Cooling stopping temperature (° C.) | cold reduction ratio(%) | Spheroidizing temperature (° C.)/hour(hr) | Spheroidized ratio (%) | average carbide diameter (μm) | In austenatizing heat treatment, a time until spheroidized carbide is redissolved (sec) | Note |
|---|---|---|---|---|---|---|---|
| 1 | 450 | 30 | 650/5 | 95 | 0.48 | 150 sec | Comparative steel 1 |
| | 550 | 30 | 650/5 | 95 | 0.44 | 150 sec | Comparative steel 2 |
| 2 | 300 | 20 | 650/5 | 99 | 0.61 | 180 sec | Comparative steel 3 |
| | 550 | 30 | 650/3 | 92 | 0.23 | 30 sec | Inventive steel 1 |
| | 600 | 30 | 650/5 | 95 | 0.28 | 30 sec | Inventive steel 2 |
| | 600 | 30 | 650/20 | 99 | 0.58 | 180 sec | Comparative steel 4 |
| | 600 | 30 | 550/2 | 80 | 0.21 | 180 sec | Comparative steel 5 |
| | 700 | 30 | 650/5 | 87 | 0.27 | 120 sec | Comparative steel 6 |
| 3 | 580 | 10 | 600/10 | 71 | 0.25 | 300 sec | Comparative steel 7 |
| | 580 | 30 | 600/5 | 93 | 0.24 | 30 sec | Inventive steel 3 |
| | 580 | 30 | 500/7 | 62 | 0.18 | 300 sec | Comparative steel 8 |
| | 580 | 30 | 700/10 | 97 | 0.54 | 180 sec | Comparative steel 9 |

As shown in Table 2, after the final spheroidizing annealing of each specimen, the spheroidized ratio and the average diameter of fine carbides are described.

In the case of inventive steels 1 to 3, the spheroidized ratio was 90% or more, and the size of fine carbides which was 0.3 μm or less was shown (refer to FIG. 1). However, in the case of the comparative steel, the size of carbide was 0.3 μm or less but the spheroidized ratio is less than 90%, or the spheroidized ratio was 90% or more but the size of carbide was 0.5 μm or more, which showed that the relatively coarse carbides was included.

In addition, in the case of the comparative steel, in the austenitizing heat treatment at 900° C., the time required to redissolve the carbide was largely increased. In the case of comparative steels 1 and 2, since the content of carbon was 0.22%, which was low, the spheroidized ratio satisfied 90% or more of the target in the exemplary embodiment of the present invention, but since the size of carbide was 0.3 μm or more, the relatively long heat treatment time is required to redissolve the carbide.

In addition, in comparative steel 3, since the cooling stopping was implemented at the relatively low temperature, overall hot rolled microstructure was martensite. Accordingly, when comparative steel 3 was cold rolled, it was impossible to set the reduction ratio to 20% or more.

In addition, since the growth ratio of spheroidized carbide in martensite was faster than the growth ratio of spheroidized carbide in known pearlite, the size of final carbides was more than 0.3 μm.

Comparative steels 4 and 5 are the cases of increasing or decreasing the spheroidizing annealing heat treatment time respectively. As described above, in the case of increasing the spheroidizing annealing time, the spheroidized ratio of 90% or more could be obtained, but the size of carbide was more than 0.3 μm. On the other hand, in the case of decreasing the spheroidizing annealing time, the size of carbide was 0.3 μm or less, but it was impossible to ensure the spheroidized ratio of 90% or more.

Comparative steel 6 is steel obtained by increasing the cooling stopping temperature in the hot rolling, forming the coarse pearlite structure, and performing cold rolling and spheroidizing annealing. In comparative steel 6, as the cementite lamellar interval of pearlite was coarsened, the spheroidizing annealing speed was decreased. As a result, the final spheroidized ratio of comparative steel 6 was 87% and the spherodized ratio of 90% or more could not be obtained.

Figure 2:
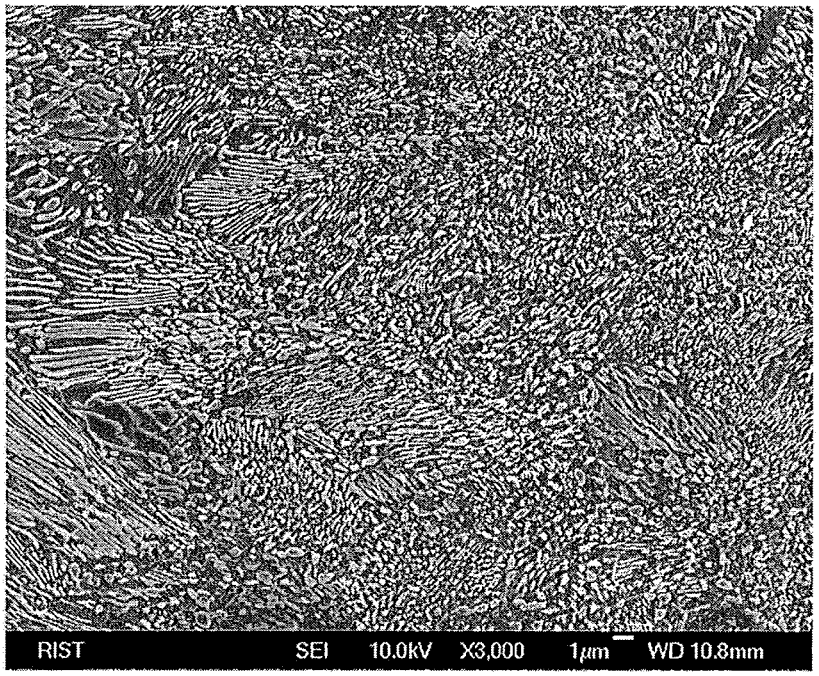
FIG. 2 is a microscopic picture that illustrates a crystal structure of a hot rolled steel sheet manufactured according to a condition of comparative steel 7 according to an exemplary embodiment of the present invention.

In the case of comparative steel 7, the reduction ratio in the cold rolling was 10%, but a decrease in the cold rolling reduction ratio affected a decrease of the spheroidizing speed, such that the spheroidized ratio was largely reduced to 71% (refer to FIG. 2).

Figure 3:
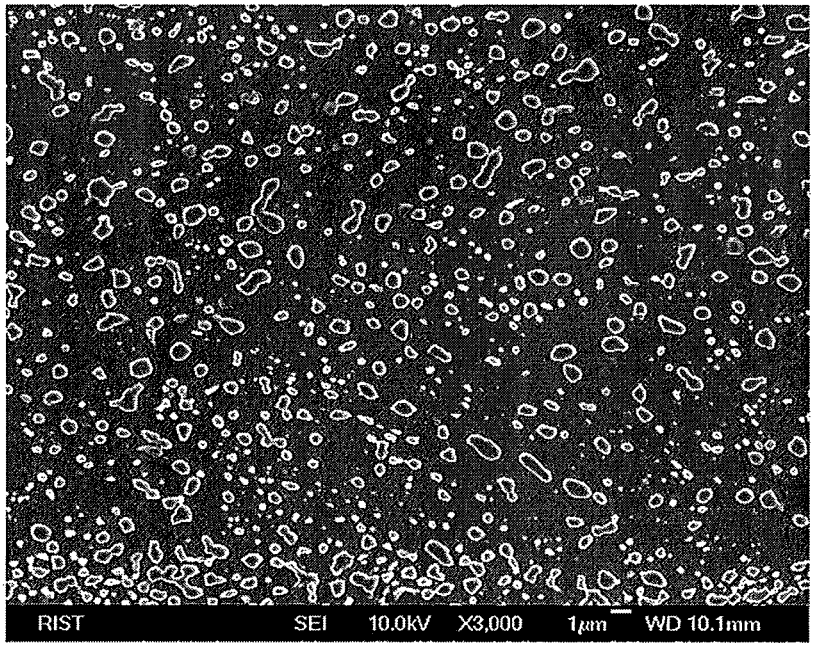
FIG. 3 is a microscopic picture that illustrates a crystal structure of a hot rolled steel sheet manufactured according to a condition of comparative steel 9 according to an exemplary embodiment of the present invention.

Comparative steels 8 and 9 are the cases of decreasing or increasing the spheroidal temperature respectively. As described above, in the case of decreasing the spheroidal temperature, since the spheroidizing speed was decreased, the spheroidized ratio was not sufficient. On the other hand, in the case of increasing the spheroidizing temperature, since the growth ratio of carbide was largely increased, the relatively coarse carbide was obtained (refer to FIG. 3).

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A fine spheroidized steel sheet having an excellent heat treatment characteristic, comprising:

0.5 to 1.0 wt % of C, 0.1 to 1.2 wt % of Mn, 0 to 0.4 wt % of Si, 0.01 to 0.1 wt % of Al, 0 to 0.01 wt % of S, and Fe and an inevitably added impurity as residuals, wherein the fine spheroidized steel sheet has a fine pearlite structure in which a lamellar interval of cementite at room temperature after a hot rolling and cold rolling is 1.0 μm or less, and a volume fraction of the fine pearlite is 80% or more, and wherein in the fine spheroidized steel sheet, an average diameter of a spheroidized carbide after spheroidizing annealing is 0.3 μm or less, and a spheroidized ratio is 90% more.

2. The fine spheroidized steel sheet having an excellent heat treatment characteristic of claim 1, wherein:

in the fine pearlite structure of the fine spheroidized steel sheet, the lamellar interval of cementite after the cold rolling is 0.7 μm or less.

3. The fine spheroidized steel sheet having an excellent heat treatment characteristic of claim 2, wherein:

a shape of the fine pearlite is a squashed pancake.

4. A method for manufacturing a fine spheroidized steel sheet having an excellent heat treatment characteristic, the method comprising:

manufacturing a high carbon steel slab that is formed of 0.5 to 1.0 wt % of C, 0.1 to 1.2 wt % of Mn, 0 to 0.4 wt % of Si, 0.01 to 0.1 wt % of Al, 0 to 0.01 wt % of S, and Fe and an inevitably added impurity as residuals;

reheating the slab to a temperature of Ar3 transformation point or more;

roughing rolling the slab, and manufacturing a thin plate by performing finish rolling in an austenite region at a temperature of Ar3 transformation point or more;

rapidly cooling the thin plate in a water cooling region at a cooling speed of 50 to 300° C./sec when the thin plate is provided in the water cooling region;

finishing the cooling of the thin plate at a temperature region of 400 to 650° C. and maintaining the temperature;

winding the thin plate at a temperature region 50° C. greater than temperature range of finishing the cooling;

omitting pre-annealing of the wound thin plate and performing cold rolling at a reduction ratio of 30% or more; and spheroidizing annealing the cold rolled thin plate at a temperature region of Ac1-200° C. to Ac1-50° C. for 5 hours or less.

5. The method of claim 4, wherein:

after the winding step, the microstructure of the thin plate has a fine pearlite structure in which the lamellar interval of cementite is 1.0 μm or less, and a volume fraction of the fine pearlite is 80% or more.

6. The method of claim 5, wherein:

after the cold rolling step, the microstructure of the thin plate has a fine pearlite structure in which the lamellar interval of cementite is 0.7 μm or less, and the shape of the fine pearlite is the squashed pancake.

7. The method of claim 4, wherein:

after the spheroidizing annealing, in the microstructure of the thin plate, the average diameter of the spheroidized carbide is 0.3 μm or less, and the spheroidized ratio is 90% or more.

* * * * *

UNITED STATES PATENT AND TRADEMARK OFFICE

CERTIFICATE OF CORRECTION

PATENT NO. : 8,440,030 B2
APPLICATION NO. : 13/141739
DATED : May 14, 2013
INVENTOR(S) : Lee et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 21 days.

Signed and Sealed this
Eighth Day of September, 2015

Michelle K. Lee

Michelle K. Lee
*Director of the United States Patent and Trademark Office*